United States Patent [19]

Vivian

[11] 4,258,615

[45] Mar. 31, 1981

[54] CEILING CONSTRUCTION FOR A HEATING, VENTILATION AND AIR CONDITIONING SYSTEM

[76] Inventor: Constantine Vivian, 72-11 45th Ave., Woodside, N.Y. 11377

[21] Appl. No.: 19,048

[22] Filed: Mar. 9, 1979

Related U.S. Application Data

[63] Continuation-in-part of Ser. No. 938,576, Aug. 31, 1978, abandoned.

[51] Int. Cl.[3] ..... F24J 3/04

[52] U.S. Cl. ..... 98/40 DL; 237/46; 236/49; 165/49; 165/16

[58] Field of Search ..... 98/40 D, 40 DL, 33 R; 165/16, 28, 49; 236/49; 237/46

[56] References Cited

U.S. PATENT DOCUMENTS

| | | | |
|---|---|---|---|
| 2,677,749 | 5/1954 | Raider | 165/28 |
| 2,730,942 | 1/1956 | Peterson | 98/40 DL |
| 3,124,903 | 3/1964 | Truhan | 98/40 D |
| 3,354,946 | 11/1967 | Dean | 98/40 DL |
| 3,366,165 | 1/1968 | Beeler | 98/40 D |
| 3,403,614 | 10/1968 | Carnes | 98/40 DL |
| 3,626,837 | 12/1971 | Pelosi | 98/36 |
| 3,693,530 | 9/1972 | Larkfeldt | 98/40 DL |
| 3,742,837 | 7/1973 | Samuelsson | 98/40 DL |

*Primary Examiner*—Henry C. Yuen
*Assistant Examiner*—Henry Bennett

[57] ABSTRACT

In a building having a heating, ventilation and air conditioning system, exterior walls and at least one story having a true ceiling, a suspended ceiling, and lighting fixtures occupying openings in the suspended ceiling, the true and suspended ceilings being vertically spaced thereby to form a plenum, the improvement is provided comprising means partitioning the plenum into an interior plenum forming a return air plenum for the system and at least one perimeter plenum, the exterior walls forming the periphery of the at least one perimeter plenum and the at least one perimeter plenum surrounding the return air plenum. In another embodiment, the improvement comprises thermally insulating material forming an interior area of the suspended ceiling and relatively thermally transmissive material forming a perimeter area of the suspended ceiling, the exterior walls forming the periphery of said perimeter area and said perimeter area surrounding the interior area.

2 Claims, 5 Drawing Figures

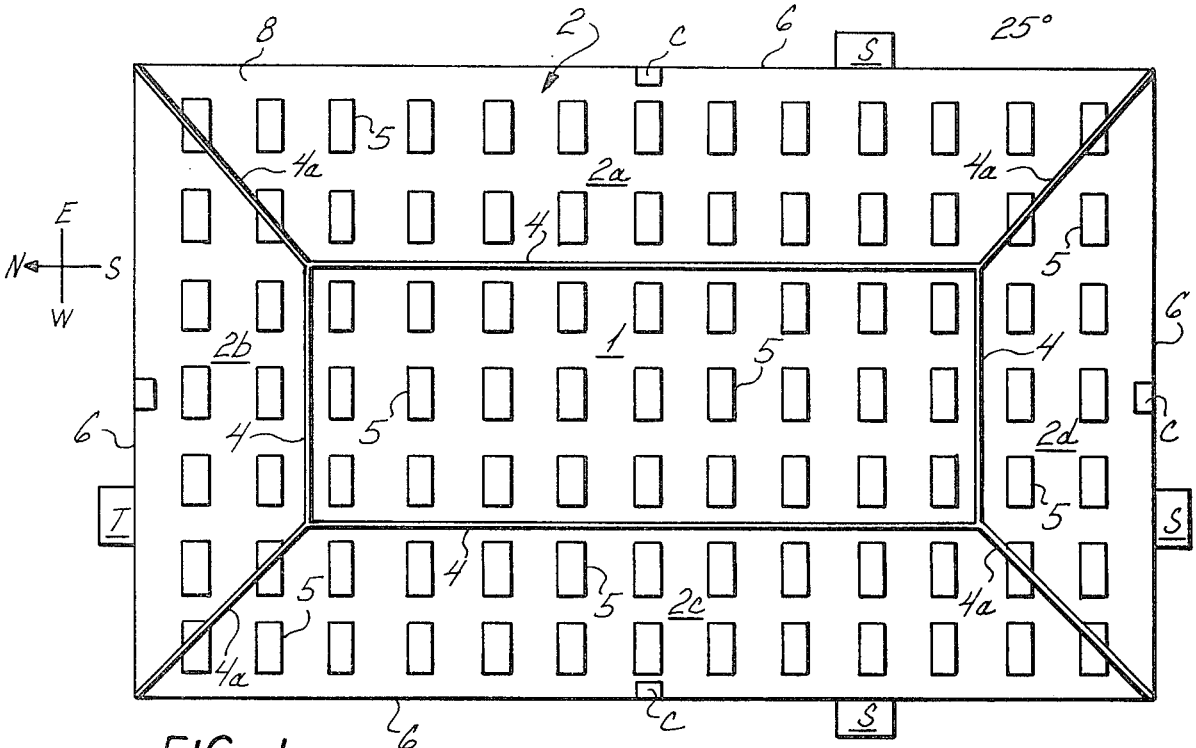
FIG. 1
FIG. 3
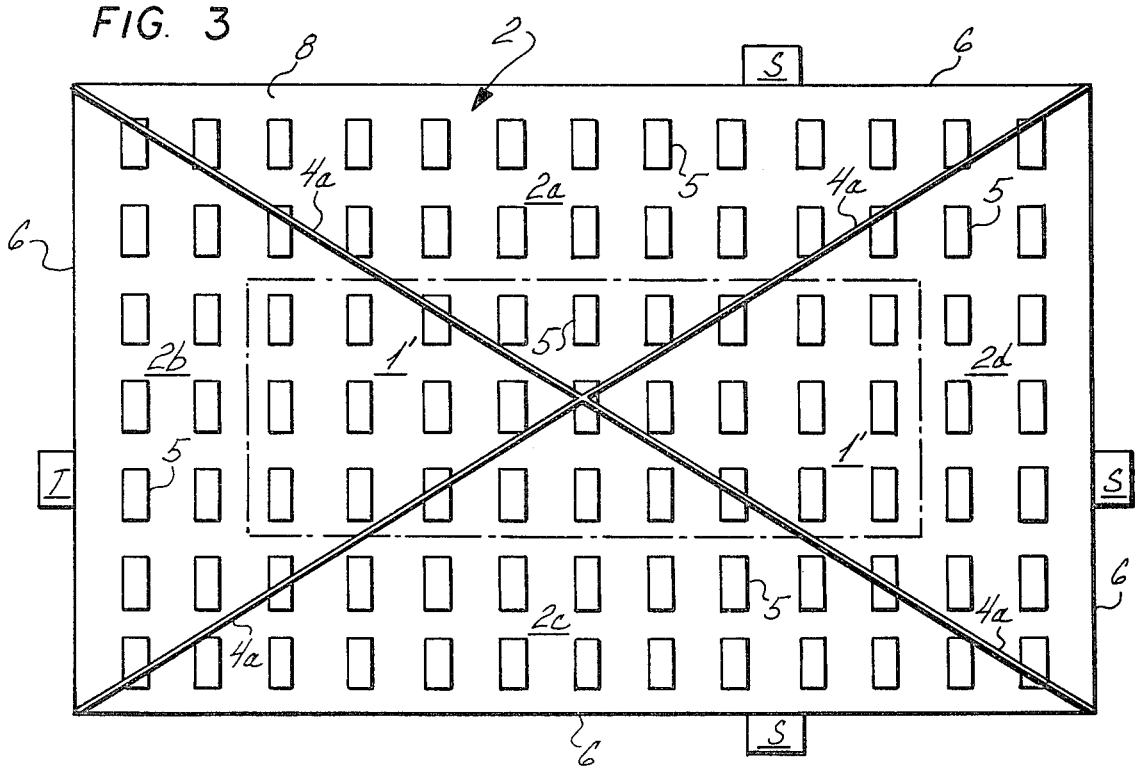

CEILING CONSTRUCTION FOR A HEATING, VENTILATION AND AIR CONDITIONING SYSTEM

REFERENCE TO RELATED APPLICATION

This is a continuation-in-part of application Ser. No. 938,576, filed Aug. 31, 1978, now abandoned.

BACKGROUND OF THE INVENTION AND PRIOR ART STATEMENT

High energy costs have increased concern for the efficient heating, ventilating and air conditioning of buildings, particularly larger office and multi-residential structures. Such structures, especially office buildings, typically have a central heating, ventilation and air conditioning system, of course, exterior walls, and at least one story having a true ceiling, a suspended ceiling, and lighting fixtures occupying openings in the suspended ceiling. The true and suspended ceilings are vertically spaced thereby to form a plenum. A considerable amount of heat is generated by the lights during their operation. It has been proposed to collect this heat by means of ducts, but the transporting of this heat through ducts in itself consumes energy.

It is an object of the present invention to provide a much more effective means for regulating and making use of the heat generated by the lighting fixtures in operation.

Representative prior art U.S. patents (a copy of each of which was submitted with the parent application) are as follows, U.S. Pat. Nos.: 3,124,903 (Truhan); 3,366,165 (Beeler); 3,403,614 (Carnes); 3,626,837 (Pelosi); 3,693,530 (Larkfeldt); and 3,742,837 (Samuelsson). The present invention is, however, patentably distinct from the prior art.

The Beeler patent appears to be the most relevant of the foregoing patents. Beeler discloses an air conditioning system wherein separate systems are provided to compensate for the heat load passing through the walls of the structure, for the heat generated internally by the lights in the structure and for the heat and moisture produced by the people occupying the structure. Beeler states that in this manner, the system performs most efficiently since it is not necessary to provide fresh humidity-controlled air in the first two of these systems. A perimeter system controls the flow of heat through the walls and roof of the building, the light system controls the heating of the interior of the building and the interior system supplies properly treated air for contact with the people using the building. This system includes a ceiling plenum chamber 70 containing fluorescent tubes 75. It would appear that in this system heat radiates from the ceiling 77 forming the bottom of the plenum chamber 70 into the room 71. Ducts 86 provide conditioned air to the plenum 70 whereby the temperature in the plenum 70 can be regulated. A separate source of conditioned air is provided for the space between the outer walls of the building, inner and outer windows also being provided. Superficial similarities to the present invention appear in two respects. One is the controlling of the temperature in a lighting plenum to provide a controlled radiant heating ceiling. The other is the provision of separate systems for peripheral and core zones of the building. In the present invention, however, the controlled temperature plenum ceiling is for peripheral zones and only for peripheral zones of the building. Many other distinctions between the present invention and the disclosure of the Beeler patent will be apparent from the hereinbelow description of the present invention.

The other patents noted above are much less pertinent to the present invention. Truhan provides a controlled chamber particularly adapted for growing plants. As a whole, the system is very much different in construction, purpose and effect from the present invention. From just a simplistic point of view, it may be noted, for example, that the plenum 34 in Truhan is not completely closed but, rather, communicates with the "room space" thereinbelow through apertures in plates 28 and 30. A similar comment applies to the ceiling air plenum of the Carnes patent and, likewise, the Pelosi patent. The Larkfeldt patent is merely of very general interest since it simply relates to a ventilated fluorescent tube fixture in which heat is provided in the room by blowing air through the fixture. The Samuelsson patent is of this same general nature but more sophisticated, in that the lighting fixtures communicate with plenum spaces between double windows in order to help control heat transmission through the windows, but there is no essential relation to the present invention.

SUMMARY OF THE INVENTION

According to one aspect of the invention, there is provided in a building having a heating, ventilation and air conditioning (HVAC) system, exterior walls and at least one story having a true ceiling, suspended ceiling, and lighting fixtures occupying openings in the suspended ceiling, the true and suspended ceilings being vertically spaced thereby to form a plenum, the improvement comprising means partitioning the plenum into an interior plenum forming a return air plenum for the HVAC system and at least one perimeter plenum, the exterior walls forming the periphery of the at least one perimeter plenum and the at least one perimeter plenum surrounding the return air plenum for the HVAC system. The term HVAC system is intended to encompass a system for an entire building as well as a system for part of a building.

In accordance with a further aspect of the invention, a scheduled control is located in the perimeter plenum and the system further includes means responsive to the scheduled control for ventilating the perimeter plenum. The scheduled control, which is commercially available HVAC hardware, responds to a temperature sensor located outside the building. The temperature schedule thereby maintained in the perimeter plenum parallels the thermal losses of the building.

Frequently, according to the invention, it is desirable to partition the perimeter plenum into a plurality of perimeter plenums, corresponding to the different exposures of the building. In that case, there may be provided a plurality of scheduled controls located in the respective perimeter plenums, each responding to a respective temperature sensor located outside the building on the respective exposure thereof, and respective means responsive to the respective scheduled controls for ventilating the respective perimeter plenums.

The concept of the invention may be considered a "controlled temperature plenum ceiling." What may in a sense be considered "free" heating is effected by permitting the heat generated by the lighting fixtures to raise the temperature in the controlled temperature plenum ceiling to a level that will make the controlled temperature plenum ceiling act as a radiant ceiling for the story of the building below the ceiling and as a radiant floor for the story of the building above the ceiling. The introduction of control is very simple. Controlled access of external air, that is air external of the building, into the controlled temperature plenum is provided. In other words, the controlled temperature plenum is ventilated. For example, in addition to the main or central HVAC system for the building there may be provided a separate HVAC system which communicates with the controlled temperature plenum. The term HVAC system is being used in its broadest generic sense to include any combination of heating and/or ventilating and/or air conditioning means. The ducts of the additional HVAC system can carry external air into the controlled temperature plenum. The ducts are opened and closed in response to a scheduled control located in the controlled temperature plenum. More specifically, when the temperature in the plenum has become so elevated that the temperature in the occupied space therebelow approaches being uncomfortable, the plenum is ventilated thereby to lower its temperature and, consequently, lower the temperature of the occupied space therebelow, and, conversely, when the occupied space subsequently approaches being uncomfortably cool due to the ventilating and cooling of the plenum chamber, the actuation of the thermostat causes the ventilating ducts to be closed. This description applies, of course, to a situation in which the outside temperature is lower than the desired inside temperature.

The invention is also advantageous when the outside temperature is higher than the desired inside temperature. Because the controlled temperature plenum is partitioned off from the return to any other system, the load on such other system is reduced, the heated air of the controlled temperature plenum not being included in the return air.

According to another embodiment of the invention, the improvement comprises thermally insulating material forming an interior area of the suspended ceiling and relatively thermally transmissive material forming a perimeter area of the suspended ceiling, the exterior walls forming the periphery of the perimeter area and the perimeter area surrounding the interior area. For control purposes, a scheduled control may be located in the perimeter area of the suspended ceiling and the system further includes means responsive to the scheduled control for ventilating the plenum. The scheduled control responds to a temperature sensor located outside the building. As in the system of the invention discussed hereinabove involving partitioned perimeter and interior plenums, it is frequently desirable to partition the plenum of the presently discussed system into a plurality of plenums, corresponding to the different exposures of the building. Respective portions of the exterior walls of the building, i.e., respective exposures of the building, form the peripheries of the respective plenums.

In a multi-story building, the floor is treated in the same manner as the ceiling with respect to insulation. In other words, in a multi-story building, each of the plurality of stories having a respective true ceiling and respective suspended ceiling and the floor of each story but for the first being comprised of the upper face of structure forming the true ceiling of the story below, the invention further comprises thermally insulating material comprising an area of the floor corresponding to the thermally insulated area of the suspended ceiling directly above the floor. The rest of the floor is comprised only of relatively thermally insulated material.

Again, the concept may be considered a "controlled temperature plenum ceiling." Again, a radiant heating ceiling and a radiant heating floor are provided, making use of the heat generated by the lighting fixtures. In this case, however, the interior of the building is treated differently from the perimeter of the building not by means of a physical partitioning of the plenum. Instead, the interior area of the ceiling and, likewise, the corresponding interior area of the floor in a multi-story building, are sufficiently insulated so that heat is not significantly transmitted from these areas of the plenums into the room space between the floor and the ceiling. Since the controlled temperature plenum now takes in the entire lighting system, in many instances sufficient heat will be provided for transmission into the perimeter area to completely satisfy the heating requirements of the perimeter area.

In this latter type of system, conventional supply and return ducts communicating with the ceiling plenum are provided. The temperature in the plenum is regulated by means of any conventional system for delivering air through the supply ducts and taking up air through the return ducts. For example, there may be mentioned a conventional "economizer" system. In such a system, for example, dampers may be regulated in response to a scheduled control to provide a mixture of conditioned or unconditioned outside air and recirculated air in such proportions as to regulate the temperature at the desired level. Here, as in the first described system, the scheduled controls are located in the plenums between the true and suspended ceilings. The scheduled control, responding to an outside temperature sensor, actuates the economizer or other system for changing the temperature of the air in the ceiling plenum thereby to maintain the temperature in the occupied space at the desired level.

The first described system, utilizing a partitioned ceiling plenum to define the perimeter and interior areas will generally be less expensive to install than the other system in which the perimeter and interior areas are defined by a difference in the insulating characteristics of the materials separating the plenums from the occupied space. The reason is that the former system does not require return ducts whereas the latter system does require such ducts. In the former system, the return air in any conventional HVAC system with which the system of the present invention is used flows through the interior ceiling plenum, which does not constitute part of the interior plenum. In a single story structure of in the case of the top story of a multi-story structure, the air returning through the interior plenum simply enters the conventional HVAC unit communicating with that plenum. In a building having a central HVAC system, the interior plenums of the other stories of a multi-story building may communicate with the interior plenum of the top story or directly with the central unit by such means as a simple shaftway and/or ductwork which will in any event be provided for the accommodation of mechanical and/or plumbing systems and/or as part of the HVAC system.

In connection with mentioning other ducts, it is noted that the systems of the invention will often be used in conjunction with more conventional systems for heating and/or cooling. In particular, in the occupied spaces between the radiant ceilings and floors, according to the invention there may be provided conventional means for providing supplementary heating and/or cooling. Typically, these conventional means will be arranged about the periphery of the perimeter area, in other words, adjacent the windows and/or outside walls. These means may be individual heating and/or cooling units or outlets from a conventional central HVAC system. Particularly in buildings in which the perimeter area is divided into separate offices or zones, it will be especially desirable to provide a separate one of these means individually thermostatically controlled for each of the offices or zones. In this way, the occupants of the individual offices or zones can adjust the respective temperatures of their offices or zones to meet their own preferences.

In either type of system of the invention, it will frequently be advantageous to zone the plenum ceiling. Typically, in a square or rectangular building, the ceiling will be partitioned into four zones corresponding to the four exposures of the building, the periphery of each of the zones corresponding to a respective one of the walls of the building. The same general principle applies, of course, to buildings of other shapes. Even a curvilinear building will have generally north, south, east and west exposures. Each of the plenums thus formed is individually handled by the system in the same manner as would be a single plenum. In other words, for each of the multiple controlled temperature plenums there is provided separate ventilation, economizer of the like ductwork the dampers or other regulating means for which are controlled by a separate, respective scheduled control in the respective plenum or thermostat in the occupied space or commercially available control system which monitors energy consumption of the supplementary heating and/or cooling means for the perimeter areas or combination of these systems.

In some instances, it may be found that the heat loss from the building on the southern exposure in the "heating seasons" is sufficiently lower than the heat losses on the other exposures that the heating which should be provided on the southern perimeter of the building by a controlled temperature plenum ceiling extending around the entire perimeter is not desirable. In that case, the controlled temperature plenum ceiling is not extended around to the southern exposure and the southern exposure is merely a continuation of, and treated the same as, the "core" of the building for HVAC purposes. It, therefore, is to be understood that such terms as "perimeter" and "surrounds", as used herein, are intended to include such partial perimeters or partial surroundings.

According to yet another aspect of the invention, the controlled temperature plenum ceiling system is used in conjunction with a variable air volume (VAV) HVAC system. VAV systems respond to temperature changes by effecting changes in the volumetric rate of introduction of conditioned air into the occupied space. The temperature of the air in the inlet ducts is maintained constant and thermostats proximate the discharge registers of the inlet ducts or in individual various rooms or areas of the occupied space actuate dampers or other means in the inlet ducts to vary the volumetric flow rate of the air. VAV systems are favored for the individualized comfort they provide for the occupants, but they are expensive to operate.

The thermostats or other temperature regulators for the perimeter heating means, namely the controlled temperature plenum ceiling and any auxiliary perimeter heating and/or cooling means are set about 5° F. below the thermostat settings of the VAV system. The result is that the perimeter occupied space is somewhat overheated by the controlled temperature plenum ceiling, at no cost, (together with any auxiliary perimeter heating means) and then controlled by the VAV thermostat. In all other respects, a VAV type HVAC system cooperates with a controlled temperature plenum ceiling in the same manner as any other HVAC system.

BRIEF DESCRIPTION OF THE DRAWINGS

The invention will now be further described by reference to specific embodiments thereof as illustrated in the drawings, in which:

FIG. 1 is a schematic plan of a controlled temperature plenum ceiling system according to the invention;

FIG. 3 is a schematic plan of another controlled temperature plenum ceiling according to the invention;

DETAILED DESCRIPTION OF PREFERRED EMBODIMENTS

Figure 2:
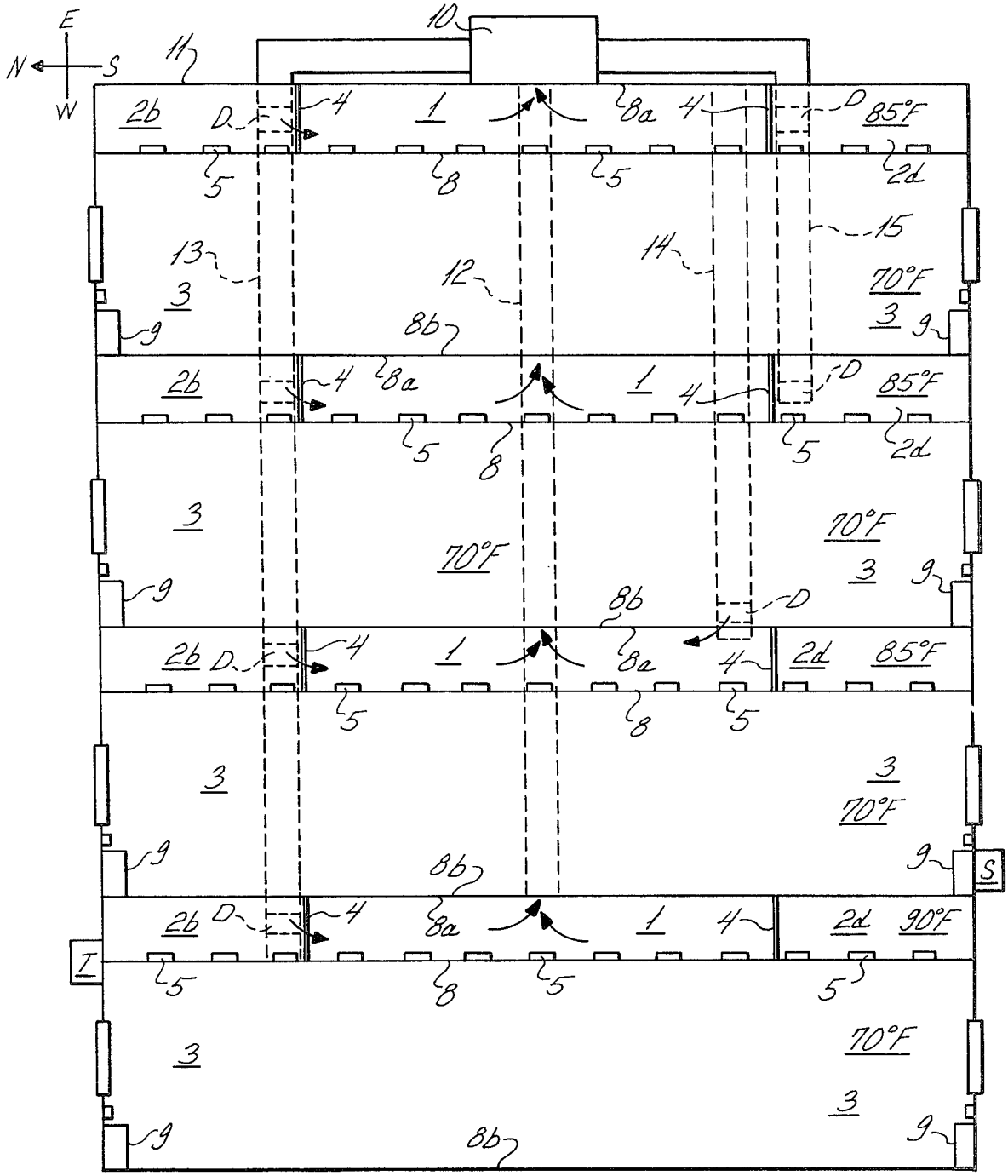
FIG. 2 is a typical section of the building including the controlled temperature plenum ceiling of FIG. 1.
Figure 2A:
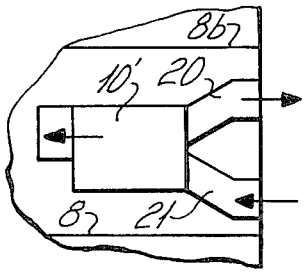
FIG. 2A is a section corresponding to a portion of FIG. 2 to show a variant of the system of FIG. 2.

FIG. 1 is as if the true ceiling were removed and one were looking directly down into the plenum between the true and suspended ceilings. The interior area 1 of the plenum functions as a return air plenum for a heating, ventilating and air conditioning system, the main unit 10 of which typically but not necessarily would be located on the roof of the building. The perimeter plenum 2 surrounding the interior plenum 1 forms the controlled temperature plenum ceiling and, if desired, may be partitioned into respective zones 2*a*, 2*b*, 2*c* and 2*d* corresponding to the respective exposures of the building. Simply by way of example, the drawing is marked to indicate that the outside temperature is 25° F. and the temperature in the occupied spaces 3 in the building is to be maintained at 70° F. A partition 4 separates the perimeter of the ceiling plenum from the interior of the ceiling plenum, the interior serving as the return air plenum 1. In accordance with conventional construction, lighting fixtures 5 are received in openings in the suspended ceiling 8, the ceiling plenum being defined by the space between the suspended ceiling 8 and the true ceiling 8*a*.

The partitioned off perimeter portions of the ceiling plenum become quite elevated in temperature because return air ia not flowing therethrough as in the case of the interior portion of the ceilin plenum 1. Just by way of example, the elevated temperatures are illustrated as being variously 85° F. and 90° F. For all stories but for the top story, the structure which defines the true ceiling 8*a* on one side defines the floor 8*b* of the story above on the other side. The space 3 in each story between the suspended ceiling 8 and the floor 8*b* may conventionally be referred to as "occupied space," since this is the space which will be occupied by the persons using the building. Around the entire perimeter of the building from the inner limit defined by the rectangular partition 4 to the outer limit defined by the exterior walls 6 of the building, the portion of the occupied space 3 of each story but for the bottom story between the perimeter plenum above the suspended ceiling 8 and the perimeter plenum beneath the floor 8*b* is substantially heated by heat radiating into the space 3 from the two plenums. The bottom story receives heat only from a plenum above, since there is no plenum below.

The perimeter plenum has been subdivided by partitions 4*a* into four zones (FIG. 2) corresponding to the four exposures of the building, compass directions being given by way of example on the lefthand side of FIG. 1. The occupied space 3 is, therefore, effectively correspondingly zoned. In each of the zones of the perimeter plenum is located a scheduled control C, all of which are operatively connected to and respond to a temperature sensor T located outside the building. To minimize the effect of sunlight on the temperature sensor T, the temperature sensor T is located on the northern exposure of the building. Optionally, on the eastern, southern and western exposures, on which significant sunlight is received, there may be provided respective solar sensors S which compensate for sunlight in sensing the temperature. In this alternative embodiment, the scheduled control for the northern side of the building is operatively connected to and responds to the temperature sensor T on the northern exposure of the building while the respective scheduled controls for the other sides of the building are operatively connected to and respond to the respective solar sensors S on the other exposures of the building.

A heating, ventilating and air conditioning unit 10 is located on the roof 11 of the building. A shaftway 12 communicates with each of the return air plenums 1 and the unit 10. Thusly, return air circulation to the unit 10 is provided. Ducts such as 13, 14 and 15 communicate between the unit 10 and the perimeter plenum zones. Communication between the perimeter plenum zones and the ducts such as 13, 14 and 15 is controlled by respective conventional dampers D or coil controls, which are operatively connected to the scheduled controls C. It will be appreciated that ducts such as 13, 14 and 15 represent two alternative systems. In one system, ducts like 13 provided with dampers D or other controls communicating with the plenum chamber of each floor may be provided. In another system, duct 13 would communicate with the plenum of the first story only (the illustrated dampers communicating with the other plenums being omitted), duct 14 with the plenum of the second story, duct 15 with the plenum of the third story, and the central unit could communicate directly with the plenum of the top story.

When an occupied space 3 approaches becoming warmer than the desired temperature, the temperature in the plenum also has increased so that the scheduled control closes a switch (not illustrated) which activates a motor (not illustrated) which opens the damper D for the respective perimeter plenum above the respective occupied space 3. Thereby, cooler air is admitted into the respective perimeter plenum, forcing out warmer air through the suspended ceiling 8 which, in accordance with conventional construction techniques, is not airtight. In other words, the perimeter plenum is ventilated. The warmer air, of course, is eventually taken up in the return air stream. When the occupied space 3 approaches becoming too cool, the temperature in the plenum also has decreased so that the scheduled control closes a switch to reverse the motor and close the damper D whereupon the temperature in the perimeter plenum and, consequently, the temperature in the occupied space begins to increase again.

The term "scheduled control" refers to a type of commercially available control which responds to a sensed temperature according to a schedule. The schedule may be different for the plenum chamber at each story. Typically, however, the schedule will be the same or just about the same for all the stories other than the bottom story, because the occupied spaces of these stories are heated by both the plenum chamber for that story and the plenum chamber for the story below, whereas the occupied space of the plenum chamber for the bottom story is heated only by the plenum chamber for that story. Mathematically speaking, the schedule is a curve of temperature sensed at the exterior of the building versus temperature required in the plenum chamber to maintain the occupied space at the desired temperature. The schedule is determined by conventional heat transfer calculations, supplemented by trial and error if necessary. Merely by way of example, for the illustrated embodiments, some points on the curve for all the plenums but the bottom story are as follows: external sensed temperature 0° F., plenum temperature 90° F.; external sensed temperature 25° F., plenum temperature 85° F.; external sensed temperature 45° F., plenum temperature 82° F.; external sensed temperature 50° F., plenum temperature 80° F.; and for the bottom story, as follows: external sensed temperature 0° F., plenum temperature 98° F.; external sensed temperature 25° F., plenum temperature 90° F.; external sensed temperature 45° F., plenum temperature 82° F.; external sensed temperature 50° F., plenum temperature 80° F. It might be noted that as the external temperature approaches the desired temperature of the occupied space, the temperature in the bottom plenum may be scheduled to be the same as the temperature for the other plenums because the heat losses from the occupied spaces to the exterior of the building are then so small.

Frequently, the perimeter occupied space 3 will be partitioned into individual offices. It may be desired that the occupants of the individual offices be able to control the temperature of their offices to their own particular comfort. Consequently, auxiliary heating and/or cooling units 9 are provided in each of the perimeter rooms. These are conventional individually thermostatically controlled units. Alternatively, the units 9 may be in the form of outlets from a central system. In other words, ductwork would be provided with individual thermostatically controlled dampers for each of the perimeter rooms. Moreover, the interior area of each story of the building is serviced by the central unit in the conventional manner for central systems, inlet ductwork being provided in the plenum 1 with outlet openings through the suspended ceiling 8 into the interior occupied area at conventionally spaced locations (not illustrated).

A system of the present invention may constitute the entire HVAC system of a building without the assistance of auxiliary heating and/or cooling units. This may be accomplished by providing one, or more in the case of zoning or individual office temperature control, anticipating thermostats in the perimeter. Such interior thermostats are used instead of exterior temperature sensors. They are integrated into the system in the same manner as exterior temperature sensors.

The above generally described alternative embodiment may readily be more specifically described by referring to FIG. 3, in which the same reference numbers as in FIGS. 1 and 2 are used for a structure analogous to the structure of FIGS. 1 and 2, and in connection therewith considering the differences from FIGS. 1 and 2. First of all, one may simply imagine that the rectangular partition 4 no longer is in place. There is, thus, one large ceiling plenum. If it is desired to zone the building in accordance with various exposures, partitions such as partitions 4a may be employed. However, in this case, the partitions 4a are extended and so angled as to form intersecting diagonals across the entire plenum. Over an area 1' corresponding to the area of the interior plenum 1 in the first embodiment, the suspended ceiling is constituted of highly insulative tiles, and the floor decking directly therebelow is comprised of highly insulative material. The term "insulative" in the context of the present invention refers to thermal insulation. The usual acoustical tile of which conventional suspended ceilings are formed is not notably effective as thermal insulation. Consequently, as in the first embodiment, heat would radiate from the relatively uninsulated perimeter plenums into the occupied space therebetween. In the interior, however, the insulation would prevent this from occurring. Consequently, the alternative embodiment is similar to the first embodiment in that the perimeter occupied spaces are heated by heat radiating from plenums above the occupied spaces and also, with the exception of the first floor, below the occupied spaces. The only other substantial difference between the second embodiment and the first embodiment is that there is no discrete interior ceiling plenum to serve as a return air plenum in the second embodiment. Rather, the entire plenum is serviced by a central unit in the same manner as would be a usual occupied space. In other words, conventional inlet and return ducts communicate with the plenums of this second embodiment. As in the first embodiment, dampers or other controls are provided in the inlet ducts in order to provide for regulation of ventilation of the plenums in response to scheduled controls which are located in the plenums and operatively connected to exterior temperature sensing means. Provision for return air flow, however, may not simply take the form of a shaftway as in the first embodiment but, instead, conventional return ducts communicating with the plenums are provided. These ducts are like the inlet ducts but are not provided with dampers or other controls since the air flows into the return ducts simply in response to the increase in pressure caused by the introduction of air through the inlet ducts.

Apart from the aforementioned differences, the system of the second embodiment is like the system of the first embodiment.

Figure 4:
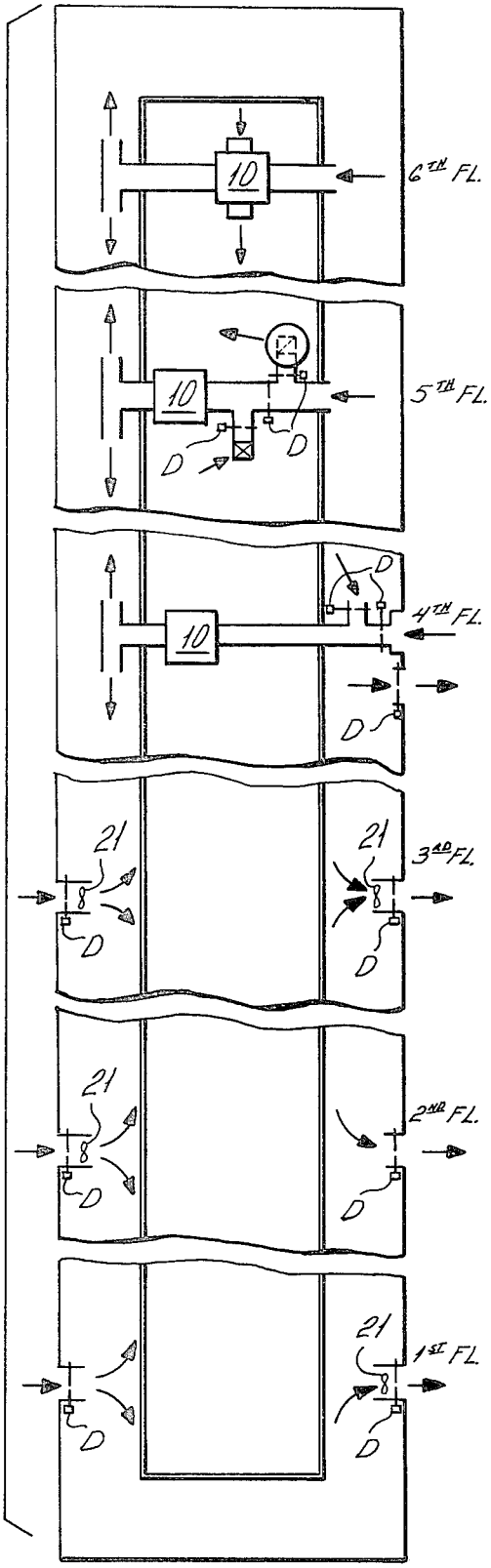
FIG. 4 is a section of a building in which are installed, for illustrative purposes, a number of different alternative embodiments of the invention.
Figure 5:
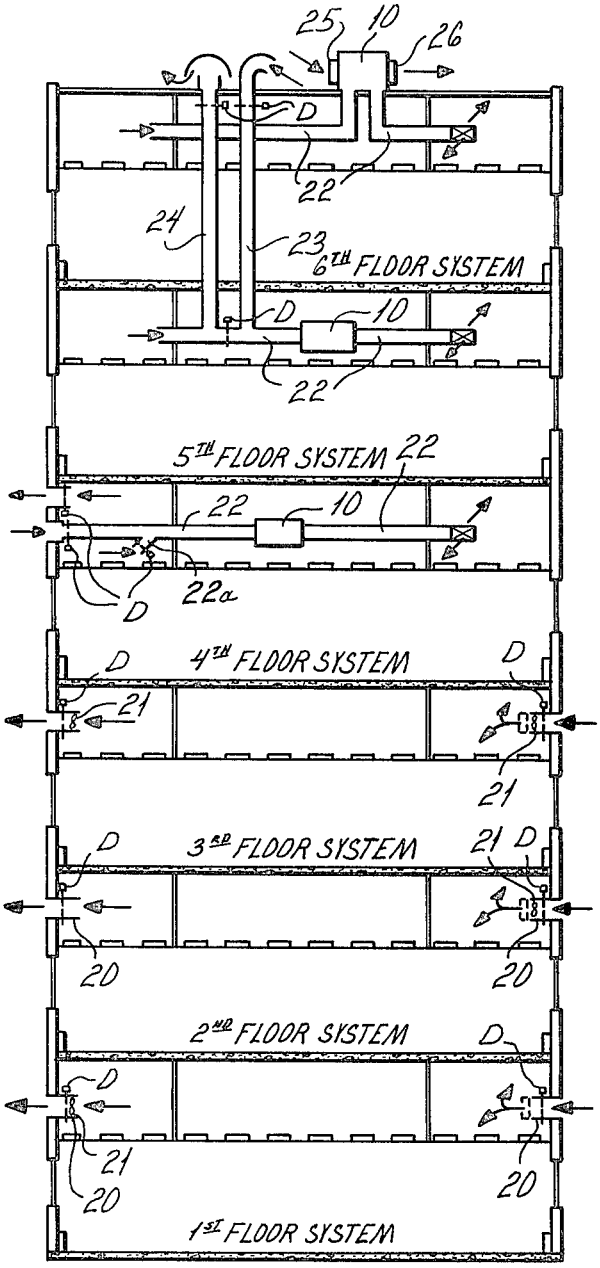
FIG. 5 is a set of plan views corresponding to FIG. 4.

Other exemplary embodiments of the invention are illustrated at different stories of a building shown in FIGS. 4 and 5. The same reference numbers are used to illustrate the same elements as in FIGS. 1 to 3, and, consequently, a description of those elements will not be repeated.

Into the first floor perimeter plenum 2 outside air is admitted through a duct 20 the opening and closing of which is effected by a damper D controlled by any such means as described above, as is also each hereafter mentioned damper D. Air is vented from the perimeter plenum 2 through a like duct 20 similarly regulated by a damper D but with the assistance of a fan 21 which is turned on and off with the respective opening and closing of the damper D associated therewith. The second floor system is similar to the first floor system except here the fan 21 is in the inlet duct to force the air into the perimeter plenum and there is no fan in the outlet duct. The third floor system is also similar except each of the inlet duct and the outlet duct is provided with a respective fan 21 so that air is forced into and out of the perimeter plenum 2. Optionally, associated with the inlet duct of any of the aforementioned three systems there may be provided a cooling, or heating or cooling, or dehumidifying coil.

The fourth floor system includes a conventional HVAC unit 10 in the interior plenum 1. Ducts 22 communicate with the unit 10. Outside air enters the duct 22 and the outside air can be mixed with air in the perimeter plenum 2 by means of a branch 22a of the duct 22 communicating with the perimeter plenum 2 and opened and closed by means of a damper D. The outlet of the duct 22, downstream of the unit 10, communicates with the perimeter plenum 2.

The fifth floor system, like the fourth floor system, includes a conventional HVAC unit 10 located in the interior plenum 1 and communicating with ducts 22. However, in this system, communicating with the duct 22 upstream of the unit 10 is a duct 23 which opens on the roof and through which outside air is introduced into the system. Air from the perimeter plenum 2 is exhausted through a duct 24 communicating with the duct 22 upstream from the duct 23 and opening on the roof. A damper D is located in the conduit 22 between the junctions of the conduit 22 with the conduits 23 and 24 to control the relative proportions of outside air and air from the perimeter plenum 2 supplied to the unit 10.

In the system illustrated in connection with the sixth floor, which is the top floor, the unit 10 is located on the roof. Outside air is mixed with air from the perimeter plenum 2 in the unit 10, which is provided with an intake 25 for outside air and an exhaust 26. The unit 10 in itself is conventional and the mixing is regulated by one or more dampers located therein.

While the invention has been particularly described by reference to specific embodiments thereof, it is not intended that the scope of the invention as defined by the hereto appended claims be limited by such description but, instead, it is intended that the claims encompass all systems making use of the principles of the invention as defined by the hereto appended claims.

What I claim is:

1. In a building having a heating, ventilation and air conditioning system, exterior walls and at least one story having a true ceiling, a suspended ceiling, and lighting fixtures occupying openings in the suspended ceiling, the true and suspended ceilings being vertically spaced thereby to form a plenum, the improvement comprising means partitioning the plenum into an interior plenum forming a return air plenum for said system and at least one perimeter plenum, the exterior walls forming the periphery of each said at least one perimeter plenum and each said at least one perimeter plenum surrounding said return air plenum and being in non-communicating relation with said return air plenum, temperature sensing means located outside said building and temperature sensing means located within said perimeter plenum, ventilation control means operatively connected to the perimeter plenum to control the ventilation of said perimeter plenum wherein said ventilation control means is regulated by a scheduled control unit that is operatively connected and responsive to the temperature sensing means located within said perimeter plenum and temperature sensing means located outside said building, said scheduled control unit being arranged to change the perimeter plenum temperature by regulating said ventilation control means in response to changes in the sensed temperature outside the building and thereby regulate the radiant heat transfer from the perimeter plenum to the space below the suspended ceiling, the suspended ceiling allowing the passage of air between the space below the suspended ceiling and the plenums.

2. In a building according to claim 1, the improvement further comprising means partitioning the perimeter plenum into a plurality of perimeter plenums.

* * * * *